US007189484B2

(12) United States Patent
Kellie et al.

(10) Patent No.: US 7,189,484 B2
(45) Date of Patent: Mar. 13, 2007

(54) REDUCED LIGHT SCATTERING IN PROJECTED IMAGES FORMED FROM ELECTROGRAPHIC TONERS

(75) Inventors: Truman F. Kellie, Lakeland, MN (US); Charles W. Simpson, Lakeland, MN (US)

(73) Assignee: Samsung Electronics Co., Ltd., Suwon (KR)

( * ) Notice: Subject to any disclaimer, the term of this patent is extended or adjusted under 35 U.S.C. 154(b) by 155 days.

(21) Appl. No.: 10/750,458

(22) Filed: Dec. 31, 2003

(65) Prior Publication Data

US 2005/0147929 A1 Jul. 7, 2005

(51) Int. Cl.
*G03G 7/00* (2006.01)

(52) U.S. Cl. ..... 430/99; 430/117

(58) Field of Classification Search ..... 430/99, 430/117, 330

See application file for complete search history.

(56) References Cited

U.S. PATENT DOCUMENTS

| | | | | | |
|---|---|---|---|---|---|
| 4,298,309 | A | | 11/1981 | Stoltz | 414/746.5 |
| 4,420,244 | A | | 12/1983 | Landa | 399/249 |
| 4,794,651 | A | | 12/1988 | Landa et al. | 430/109.3 |
| 5,115,277 | A | | 5/1992 | Camis | 399/390 |
| 5,176,974 | A | | 1/1993 | Till et al. | 430/42 |
| 5,208,093 | A | | 5/1993 | Carls et al. | 428/195.1 |
| 5,229,203 | A | * | 7/1993 | Sato | 428/327 |
| 5,270,776 | A | * | 12/1993 | Landa | 399/68 |
| 5,410,392 | A | | 4/1995 | Landa | 399/308 |
| 5,451,458 | A | | 9/1995 | Malhotra | 428/32.28 |
| 5,517,479 | A | | 5/1996 | Nakanishi et al. | 369/44.23 |
| 5,559,592 | A | * | 9/1996 | Larson et al. | 399/328 |
| 5,635,325 | A | | 6/1997 | Inaba et al. | 430/108.4 |
| 5,824,442 | A | | 10/1998 | Tanikawa et al. | 430/45 |
| 5,908,729 | A | * | 6/1999 | Landa et al. | 430/126 |
| 5,916,718 | A | | 6/1999 | Kellie et al. | 430/45 |
| 6,255,363 | B1 | | 7/2001 | Baker et al. | 523/201 |
| 6,296,391 | B1 | | 10/2001 | Hayakawa et al. | 384/119 |
| 6,391,954 | B2 | | 5/2002 | Azizi et al. | 524/306 |

* cited by examiner

*Primary Examiner*—John L Goodrow
(74) *Attorney, Agent, or Firm*—Mark A. Litman & Associates, PA

(57) ABSTRACT

A method of manufacturing transparencies reduces light scattering in a projection transparency formed with an electrostatically deposited color image. The method comprises:

providing a transparent support substrate;

forming an electrostatically deposited color developer image on the support substrate, the color developer image containing at least 25% by weight of organic liquid carrier, the color developer having dispersed particles comprising thermoplastic polymer therein, said dispersed particles having an effective Tg; and heating the color developer image on the support at a temperature and for a time that the thermoplastic polymer coalesces and at least some of the organic liquid carrier evaporates at a rate that free volume between the particles is reduced and light scattering is thereby reduced.

14 Claims, 2 Drawing Sheets

REDUCED LIGHT SCATTERING IN PROJECTED IMAGES FORMED FROM ELECTROGRAPHIC TONERS

BACKGROUND OF THE INVENTION

1. Field of the Invention

The present invention relates to the field of projected images, particularly overhead projected images and overhead projected images formed from inks or toners applied to transparency receptor films by electrostatic imaging processes, such as electrophotography.

2. Background of the Art

Electrophotography forms the technical basis for various well-known imaging processes, including photocopying and some forms of laser printing. Other imaging processes use electrostatic or ionographic printing. Electrostatic printing is printing where a dielectric receptor or substrate is "written" upon imagewise by a charged stylus, leaving a latent electrostatic image on the surface of the dielectric recpetor. This dielectric receptor is not photosensitive and is generally not re-useable. Once the image pattern has been "written" onto the dielectric receptor in the form of an electrostatic charge pattern of positive or negative polarity, oppositely charged toner particles are applied to the dielectric receptor in order to develop the latent image. An exemplary electrostatic imaging process is described in U.S. Pat. No. 5,176,974.

In contrast, electrophotographic imaging processes typically involve the use of a reusable, light sensitive, temporary image receptor, known as a photoreceptor, in the process of producing an electrophotographic image on a final, permanent image receptor. A representative electrophotographic process involves a series of steps to produce an image on a receptor, including charging, exposure, development, transfer, fusing, and cleaning, and erasure.

In the charging step, a photoreceptor is covered with charge of a desired polarity, either negative or positive, typically with a corona or charging roller. In the exposure step, an optical system, typically a laser scanner or diode array, forms a latent image by selectively exposing the photoreceptor to electromagnetic radiation, thereby discharging the charged surface of the photoreceptor in an imagewise manner corresponding to the desired image to be formed on the final image receptor. The electromagnetic radiation, which may also be referred to as "light", may include infrared radiation, visible light, and ultraviolet radiation, for example.

In the development step, toner particles of the appropriate polarity are generally brought into contact with the latent image on the photoreceptor, typically using a developer electrically-biased to a potential opposite in polarity to the toner polarity. The toner particles migrate to the photoreceptor and selectively adhere to the latent image via electrostatic forces, forming a toned image on the photoreceptor.

In the transfer step, the toned image is transferred from the photoreceptor to the desired final image receptor; an intermediate transfer element is sometimes used to effect transfer of the toned image from the photoreceptor with subsequent transfer of the toned image to a final image receptor. The transfer of an image typically occurs by one of the following two methods: elastomeric assist (also referred to herein as "adhesive transfer") or electrostatic assist (also referred to herein as "electrostatic transfer").

Elastomeric assist or adhesive transfer refers generally to a process in which the transfer of an image is primarily caused by balancing the relative energies between the ink, a photoreceptor surface and a temporary carrier surface or medium for the toner. The effectiveness of such elastomeric assist or adhesive transfer is controlled by several variables including surface energy, temperature, pressure, and toner rheology. An exemplary elastomeric assist/adhesive image transfer process is described in U.S. Pat. No. 5,916,718.

Electrostatic assist or electrostatic transfer refers generally to a process in which transfer of an image is primarily affected by electrostatic charges or charge differential phenomena between the receptor surface and the temporary carrier surface or medium for the toner. Electrostatic transfer may be influenced by surface energy, temperature, and pressure, but the primary driving forces causing the toner image to be transferred to the final substrate are electrostatic forces. An exemplary electrostatic transfer process is described in U.S. Pat. No. 4,420,244.

In the fusing step, the toned image on the final image receptor is heated to soften or melt the toner particles, thereby fusing the toned image to the final receptor. An alternative fusing method involves fixing the toner to the final receptor under high pressure with or without heat. In the cleaning step, residual toner remaining on the photoreceptor is removed.

Finally, in the erasing step, the photoreceptor charge is reduced to a substantially uniformly low value by exposure to light of a particular wavelength band, thereby removing remnants of the original latent image and preparing the photoreceptor for the next imaging cycle.

Two types of toner are in widespread, commercial use: liquid toner and dry toner. The term "dry" does not mean that the dry toner is totally free of any liquid constituents, but connotes that the toner particles do not contain any significant amount of solvent, e.g., typically less than 10 weight percent solvent (generally, dry toner is as dry as is reasonably practical in terms of solvent content), and are capable of carrying a triboelectric charge.

A typical liquid toner composition generally includes toner particles suspended or dispersed in a liquid carrier. The liquid carrier is typically nonconductive dispersant, to avoid discharging the latent electrostatic image. Liquid toner particles are generally solvated to some degree in the liquid carrier (or carrier liquid), typically in more than 50 weight percent of a low polarity, low dielectric constant, substantially nonaqueous carrier solvent. Liquid toner particles are generally chemically charged using polar groups that dissociate in the carrier solvent, but do not carry a triboelectric charge while solvated and/or dispersed in the liquid carrier. Liquid toner particles are also typically smaller than dry toner particles. Because of their small particle size, ranging from about 5 microns to sub-micron, liquid toners are capable of producing very high-resolution toned images. This distinguishes dry toner particles from liquid toner particles.

A typical toner particle for a liquid toner composition generally comprises a visual enhancement additive (for example, a colored pigment particle) and a polymeric binder. The polymeric binder fulfills functions both during and after the electrophotographic process. With respect to processability, the character of the binder impacts charging and charge stability, flow, and fusing characteristics of the toner particles. These characteristics are important to achieve good performance during development, transfer, and fusing. After an image is formed on the final receptor, the nature of the binder (e.g. glass transition temperature, melt viscosity, molecular weight) and the fusing conditions (e.g. temperature, pressure and fuser configuration) impact durability (e.g. blocking and erasure resistance), adhesion to the receptor, gloss, and the like.

Polymeric binder materials suitable for use in liquid toner particles typically exhibit glass transition temperatures of about −24° C. to 55° C., which is lower than the range of glass transition temperatures (50–100° C.) typical for polymeric binders used in dry toner particles. In particular, some liquid toners are known to incorporate polymeric binders exhibiting glass transition temperatures ($T_g$ below room temperature (25° C.) in order to rapidly self fix, e.g., by film formation, in the liquid electrophotographic imaging process; see e.g. U.S. Pat. No. 6,255,363. However, such liquid toners are also known to exhibit inferior image durability resulting from the low $T_g$ (e.g. poor blocking and erasure resistance) after fusing the toned image to a final image receptor.

In other printing processes using liquid toners, self-fixing is not required. In such a system, the image developed on the photoconductive surface is transferred to an intermediate transfer belt ("ITB") or intermediate transfer member ("ITM") or directly to a print medium without film formation at this stage. See, for example, U.S. Pat. No. 5,410,392 to Landa, issued on Apr. 25, 1995; and U.S. Pat. No. 5,115,277 to Camis, issued on May 19, 1992. In such a system, this transfer of discrete toner particles in image form is carried out using a combination of mechanical forces, electrostatic forces, and thermal energy. In the system particularly described in the '277 patent, DC bias voltage is connected to an inner sleeve member to develop electrostatic forces at the surface of the print medium for assisting in the efficient transfer of color images.

The toner particles used in such a system have been previously prepared using conventional polymeric binder materials, and not polymers made using an organosol process. Thus, for example the '392 patent states that the liquid developer to be used in the disclosed system is described in U.S. Pat. No. 4,794,651 to Landa, issued on Dec. 27, 1988. This patent discloses liquid toners made by heating a preformed high $T_g$ polymer resin in a carrier liquid to an elevated temperature sufficiently high for the carrier liquid to soften or plasticize the resin, adding a pigment, and exposing the resulting high temperature dispersion to a high energy mixing or milling process.

Although such non self-fixing liquid toners using higher $T_g$ ($T_g$ generally greater than or equal to about 60° C.) polymeric binders should have good image durability, such toners are known to exhibit other problems related to the choice of polymeric binder, including image defects due to the inability of the liquid toner to rapidly self fix in the imaging process, poor charging and charge stability, poor stability with respect to agglomeration or aggregation in storage, poor sedimentation stability in storage, and the requirement that high fusing temperatures of about 200–250° C. be used in order to soften or melt the toner particles and thereby adequately fuse the toner to the final image receptor.

To overcome the durability deficiencies, polymeric materials selected for use in both nonfilm-forming liquid toners and dry toners more typically exhibit a range of $T_g$ of at least about 55–65° C. in order to obtain good blocking resistance after fusing, yet typically require high fusing temperatures of about 200–250° C. in order to soften or melt the toner particles and thereby adequately fuse the toner to the final image receptor. High fusing temperatures are a disadvantage for dry toners because of the long warm-up time and higher energy consumption associated with high temperature fusing and because of the risk of fire associated with fusing toner to paper at temperatures approaching the autoignition temperature of paper (233° C.).

In addition, some liquid and dry toners using high $T_g$ polymeric binders are known to exhibit undesirable partial transfer (offset) of the toned image from the final image receptor to the fuser surface at temperatures above or below the optimal fusing temperature, requiring the use of low surface energy materials in the fuser surface or the application of fuser oils to prevent offset. Alternatively, various lubricants or waxes have been physically blended into the dry toner particles during fabrication to act as release or slip agents; however, because these waxes are not chemically bonded to the polymeric binder, they may adversely affect triboelectric charging of the toner particle or may migrate from the toner particle and contaminate the photoreceptor, an intermediate transfer element, the fuser element, or other surfaces critical to the electrophotographic process.

Since the introduction of electrophotographic copying and printing machines using dry toner powder particles to develop electrostatic images, there has been a continuing emphasis on toner image transfer with faithful, high quality, durable fused image reproduction on the surface of a receptor sheet. Previous studies related to the quality of images produced by transfer of toner powder, from imaging drums of electrophotographic copiers and printers to suitable recording sheets, focused attention on the bond formed between the powder and the recording sheet. Having demonstrated sufficient adhesion, measurement of optical density indicated the intensity of the image formed on the recording sheet, as shown by U.S. Pat. Nos. 5,451,458. 5,302,439 discloses a recording sheet which comprises a substrate and a coating thereon Materials from the various groups increase the adhesion of toner powder to the recording sheet.

More recently, attention has turned to improvement of the projected transparency of images formed by fusing dry toner particles to transparent receptor films, Poor transparency of fused dry toner images is believed to result from multiple light scattering from solid particles (e.g. pigment particles) having a volume mean diameter generally larger than approximately 0.5–1 micron, such that light projected through the fused toner layer undergoes multiple scattering from the solid particles. Alternatively, multiple light scattering may occur at the surfaces and edges of the fused transparency image when the projector's light source is transmitted through the fused toned image on the transparency receptor.

The problem of light scattering is particularly undesirable and tends to be more noticeable with the use of colored pigments. In the use of black and white images, light scatter tends to only cause increased opacity or increased transmission optical density of the projected image, which is minimally problematic, as the projected image actually appears more black, However, when light is scattered by multicolored pigment particles, there is a color shift effected, and this results in not only altering the transmitted optical density and projected imagte opacity, but also the color content itself. The imaging process must retain the ability to provide high fidelity to the intended colors and high color quality when the fused toned image on the receptor film is projected, or the image quality will be seriously degraded. For example, one of the most apparent scattering effects is noted in overhead projection of toned yellow colors, where the projected yellow image is often "muddy," appearing as gold, light green, brown or even black, depending upon smoothness of the fused toner film and the extent of light scattering from the surface of the fused toned image.

Various approaches have been used in the art to improve the projected transparency of fused dry toner images. One approach involves alteration of the toner composition to improve uniformity of the fused toner layer on the transparent image receptor. U.S. Pat. No. 5,635,325 discloses a core/shell toner for developing electrostatic images including a binder resin, a colorant and an ester wax, wherein the core melts and acts as a release agent during fusing, eliminating the need for silicone based release agents to be applied to the fuser rolls.

Other approaches to improve the projection quality of fused dry toner images on transparency receptors involve use of special coatings on the transparency receptor to improve coalescence of the toner powders into a smooth, uniform layer on the receptor. U.S. Pat. Nos. 5,208,093, 4,298,309 and 5,635,325 disclose a variety of solutions to achieve miscibility of the coated film with the toner while maintaining low melt viscosity. U.S. Pat. No. 5,451,458 discloses a recording sheet which comprises a substrate and a coating thereon containing a binder selected from polyesters, polyvinyl acetals, vinyl alcohol-vinyl acetal copolymers, polycarbonates, and mixtures thereof, and an additive having a melting point of less than about 65 degree C. and a boiling point of more than about 150 degree C. U.S. Pat. Nos. 6,391,954 and 6,296,931 describe a recording sheet including an additive, referred to as a compatibilizer, to improve the quality of images formed by toner powder development of electrostatic charge patterns.

Still other approaches are directed at improved toner transparency using special fixing methods for fusing the dry toner powder to the receptor sheet. U.S. Pat. No. 5,824,442 describes the use of special toners in such a fixing method. U.S. Pat. No. 5,519,479 describes a fusing or fixing device for use in an electrophotographic apparatus, comprising a pair of pressing means opposing each other to form therebetween a nip through which an image supporting member supporting an unfixed toner image is passed so that the toner image is fixed to the image supporting member, wherein one of the pressing means which contacts the toner image on the image supporting member has a layer formed of a soft matrix and granular particles dispersed in the matrix and having greater hardness than the matrix, whereby fine irregularities are formed on toner surfaces on the image supporting member by the granular particles under application of pressure during fixing. This is clearly contraindicated as a solution against light scattering that shifts color balance and fidelity.

For the case of fused liquid toner images on transparent receptor sheets, all of the previously described problems may occur. Poor fused toner adhesion, unacceptable projected image transparency due to light scattering by oversized pigment particles or surface irregularities in the fused toner layer, and poor color fidelity in multi-color fused toner images remain problematic. In addition, the difficulty of producing durable, transparent, multi-colored fused liquid toner images on transparency receptors is compounded by the fact that a substantial amount of carrier liquid is typically present in the toned image prior to fusing on the final transparency receptor. The latter issue is particularly problematic for transparencies produced using liquid electrophotographic imaging processes that make use of an electrostatic transfer assist to transfer the toned image to the final image receptor, because a substantial amount of carrier liquid is required in the toned image in order to effect electrostatic transfer. This carrier liquid may have adverse effects on the durability of the fused liquid toner image if it remains in the fused image. Alternatively, removal of the carrier liquid may have adverse effects on the transparency and color fidelity of the projected liquid toned image.

The art continually searches for way of improving the durability, projected transparency and projected color fidelity of liquid toned images fused on transparent receptors. The art also searches for improved methods of producing multi-colored, fused liquid toned images on transparency receptors using electrophotographic imaging processes having an electrostatic image transfer assist for transferring the toned image to the transparency receptor.

SUMMARY OF THE INVENTION

In one aspect of the invention, toner particles in a liquid toner developed image are rapidly coalesced to form a film that entraps carrier liquid within the toned image layer during fusion to a transparent receptor sheet, thereby improving the transparency and color fidelity of the projected fused image. In a preferred embodiment, the fusing temperature is sufficient to induce coalescence of the toner particles, but insufficient to evaporate substantially all of the carrier liquid from the fused toned image.

In another aspect of the invention, the toner particles in a toned image are induced to flow and coalesce into a continuous film in which the free volume occupied by carrier liquid is substantially eliminated and air-filled voids are thereby substantially eliminated. The resulting fused toner image on the transparent receptor sheet thereby exhibits improved toner adhesion to the transparency receptor, enhanced projected image transparency, and improved color fidelity in the projected image.

In a preferred embodiment, the coalescence occurs after development of the liquid toner to provide a toned image with sufficient carrier liquid remaining therein to permit electrostatic assisted transfer of the toned image to the final transparency receptor. Preferably, toner particle coalescence is induced by heating the toned image to a temperature high enough above the effective glass transition temperature of the liquid toner particles so as to induce coalescence, but below the temperature required to fuse the toned image to the transparency receptor, and subsequently heating the coalesced toned image to a higher temperature sufficient to fuse the toned image to the transparency receptor.

In another preferred embodiment, the presence of the carrier liquid within the toned image after coalescence also acts to plasticize the polymeric binder used in the toner particles, thereby permitting coalescence of the toner particles and fusion of the toned image to the transparency receptor at lower temperatures than comparable dry powder toners. The fusion is preferably performed rapidly enough to assure that sufficient carrier liquid is evaporated from the toned image so as to obtain adequate toner adhesion and blocking resistance of the fused toned image on the transparency receptor.

DETAILED DESCRIPTION OF THE INVENTION

Figure 1:
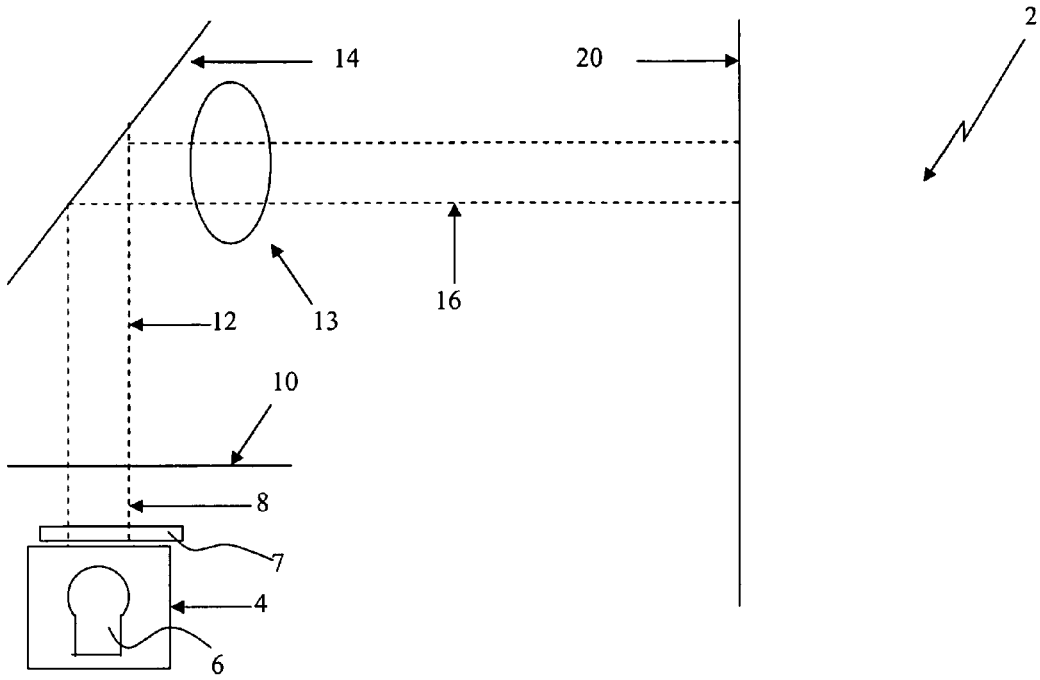
FIG. 1 shows a schematic of overhead projection of images through a transparency.

A liquid electrophotographic toner composition generally comprises a visual enhancement additive or colorant, a polymeric binder, and a carrier liquid. The colorant may be an organic or inorganic pigment, a dye, or an oil-soluble dye.

Nonexclusive examples thereof include C.I. Pigment Red 48:1, C.I. Pigment Red 57:1, C.I. Pigment Red 122, C.I. Pigment Red 17, C.I. Pigment Yellow 97, C.I. Pigment Yellow 12, C.I. Pigment Blue 15:1, C.I. Pigment Blue 15:3, lamp black (C.I. No. 77266), Rose Bengal (C.I. No. 45432), carbon black, Nigrosine dye (C.I. No. 50415B), metal complex dyes, metal complex dye derivatives, and mixtures thereof. Examples of the colorant further include various metal oxides such as silica, aluminum oxide, magnetite and various ferrites, cupric oxide, nickel oxide, zinc oxide, zirconium oxide, titanium oxide, and magnesium oxide, and appropriate mixtures thereof. Colorants should be incorporated into toner particles in such an amount that the toner is capable of forming a visible image having sufficient density. Although colorant amount varies depending on toner particle diameter and deposited toner amount, the adequate range thereof is generally about from 1 to 200 parts by weight per 100 parts by weight of the polymeric binder.

The polymeric binder is generally selected from the broad class of thermoplastic polymers. Virtually any thermoplastic polymer may be used for forming the toner particles as long as the thermoplastic polymer is substantially insoluble in the carrier at the temperature of the developer during development. Examples of suitable thermoplastic polymers include polyolefins such as polyethylene and polypropylene. Suitable polymer resins include ethylene copolymers having a polar group, e.g., copolymers of ethylene with alpha, beta-ethylenically-unsaturated acids, such as acrylic acid and methacrylic acid, or with alkyl esters of these acids and ionomers obtained from such ethylene copolymers by converting the acid moieties into a metal salt, amine salt, or ammonium salt. A process for synthesizing this type of copolymers is described, e.g., in U.S. Pat. No. 3,264,272 to Ree.

Other suitable thermoplastic resins include homopolymers of styrene, o-, m-, or p-methylstyrene, .alpha.-methylstyrene, p-ethylstyrene, 2,4-dimethylstyrene, and the like, styrene-acrylic copolymers, and copolymers of styrene with other monomers. Examples of the acrylic monomers used for producing the styrene-acrylic copolymers include methyl acrylate, ethyl acrylate, propyl acrylate, n-butyl acrylate, isobutyl acrylate, n-hexyl acrylate, n-octyl acrylate, 2-ethylhexyl acrylate, decyl acrylate, lauryl acrylate, stearyl acrylate, 2-chloroethyl acrylate, phenyl acrylate, and the corresponding methacrylic esters. Examples thereof further include .alpha.-methylenemonocarboxylic acid esters such as dimethylaminoethyl methacrylate and diethylaminoethyl methacrylate, ammonium methacrylate, and betaines thereof.

Also usable are homopolymers of the acrylic acid derivatives enumerated above, homopolymers of perfluorooctyl (meth)acrylate, vinyltoluenesulfonic acid, and the sodium salt, vinylpyridine compound, and pyridinium salt thereof, copolymers of these monomers with other monomers, copolymers of a diene, e.g., butadiene or isoprene, with a vinyl monomer, and polyamide resins based on a dimer acid. Moreover, polyesters, polyurethanes, and the like may be used alone or as a mixture with the resins enumerated above.

Preferred polymeric binders for liquid electrophotographic toners useful according to the present invention include thermoplastic, amphipathic copolymers, particularly graft copolymers.

A preferred liquid toner fabrication technique involves synthesizing the amphipathic copolymeric binder dispersed in a liquid carrier to form an organosol, then mixing the formed organosol with other ingredients to form a liquid toner composition. Detailed procedures for preparing exemplary organosol liquid toners are described in copending, commonly-assigned U.S. patent application Ser. No. 10/612,533 filed Jun. 30, 2003, entitled ORGANOSOL INCLUDING AMPHIPATHIC COPOLYMERIC BINDER MADE WITH SOLUBLE HIGH $T_G$ MONOMER AND LIQUID TONERS FOR ELECTROPHOTOGRAPHIC APPLICATIONS," which application is incorporated herein by reference in its entirety.

Typically, organosols are synthesized by nonaqueous dispersion polymerization of polymerizable compounds (e.g. monomers) to form copolymeric binder particles that are dispersed in a low dielectric hydrocarbon solvent (carrier liquid). These dispersed copolymer particles are sterically-stabilized with respect to aggregation by chemical bonding of a steric stabilizer (e.g. graft stabilizer), solvated by the carrier liquid, to the dispersed core particles as they are formed in the polymerization. Details of the mechanism of such steric stabilization are described in Napper, D. H., "Polymeric Stabilization of Colloidal Dispersions," Academic Press, New York, N.Y., 1983. Procedures for synthesizing self-stable organosols are described in "Dispersion Polymerization in Organic Media," K. E. J. Barrett, ed., John Wiley: New York, N.Y., 1975.

The carrier liquid is a substantially nonaqueous solvent or solvent blend. In other words, only a minor component (generally less than 25 weight percent) of the liquid carrier comprises water. Preferably, the substantially nonaqueous liquid carrier comprises less than 20 weight percent water, more preferably less than 10 weight percent water, even more preferably less than 3 weight percent water, most preferably less than one weight percent water.

The substantially nonaqueous carrier liquid may be selected from a wide variety of materials, or combination of materials, which are known in the art, but preferably has a Kauri-butanol number less than 30 ml. The liquid is preferably oleophilic, chemically stable under a variety of conditions, and electrically insulating. Electrically insulating refers to a dispersant liquid having a low dielectric constant and a high electrical resistivity. Preferably, the liquid dispersant has a dielectric constant of less than 5; more preferably less than 3. Electrical resistivities of carrier liquids are typically greater than $10^9$ Ohm-cm; more preferably greater than $10^{10}$ Ohm-cm. In addition, the liquid carrier desirably is chemically inert in most embodiments with respect to the ingredients used to formulate the toner particles.

Examples of suitable liquid carriers include aliphatic hydrocarbons (n-pentane, hexane, heptane and the like), cycloaliphatic hydrocarbons (cyclopentane, cyclohexane and the like), aromatic hydrocarbons (benzene, toluene, xylene and the like), halogenated hydrocarbon solvents (chlorinated alkanes, fluorinated alkanes, chlorofluorocarbons and the like) silicone oils and blends of these solvents. Preferred carrier liquids include branched paraffinic solvent blends such as Isopar™ G, Isopar™ H, Isopar™ K, Isopar™ L, Isopar™ M and Isopar™ V (available from Exxon Corporation, NJ), and most preferred carriers are the aliphatic hydrocarbon solvent blends such as Norpar™ 12, Norpar™ 13 and Norpar™ 15 (available from Exxon Corporation, NJ). Particularly preferred carrier liquids have a Hildebrand solubility parameter of from about 13 to about 15 $MPa^{1/2}$.

In addition to the visual enhancement additive or colorant, other additives optionally can be formulated into the liquid toner composition. A particularly preferred additive comprises at least one charge control agent (CCA, charge control additive or charge director). The charge control agent, also known as a charge director, can be included as a separate ingredient and/or included as one or more functional moiety (ies) of the S and/or D material incorporated into the amphipathic copolymer. The charge control agent acts to enhance the chargeability and/or impart a charge to the toner particles. Toner particles can obtain either positive or negative charge depending upon the combination of particle material and charge control agent.

The charge control agent can be incorporated into the toner particles using a variety of methods, such as copolymerizing a suitable monomer with the other monomers used to form the copolymer, chemically reacting the charge control agent with the toner particle, chemically or physically adsorbing the charge control agent onto the toner particle (resin or pigment), or chelating the charge control agent to a functional group incorporated into the toner particle. One preferred method is via a functional group built into the S material of the copolymer.

The charge control agent acts to impart an electrical charge of selected polarity onto the toner particles. Any number of charge control agents described in the art can be used. For example, the charge control agent can be provided it the form of metal salts consisting of polyvalent metal ions and organic anions as the counterion. Suitable metal ions include, but are not limited to, Ba(II), Ca(II), Mn(II), Zn(II), Zr(IV), Cu(II), A1(III), Cr(III), Fe(II), Fe(III), Sb(III), Bi(III), Co(II), La(III), Pb(II), Mg(II), Mo(III), Ni(II), Ag(I), Sr(II), Sn(IV), V(V), Y(III), and Ti(IV). Suitable organic anions include carboxylates or sulfonates derived from aliphatic or aromatic carboxylic or sulfonic acids, preferably aliphatic fatty acids such as stearic acid, behenic acid, neodecanoic acid, diisopropylsalicylic acid, octanoic acid, abietic acid, naphthenic acid, lauric acid, tallic acid, and the like.

Preferred negative charge control agents are lecithin and basic barium petronate. Preferred positive charge control agents include metallic carboxylates (soaps), for example, as described in U.S. Pat. No. 3,411,936 (incorporated herein by reference). A particularly preferred positive charge control agent is zirconium tetraoctoate (available as Zirconium HEX-CEM from OMG Chemical Company, Cleveland, Ohio).

The preferred charge control agent levels for a given toner formulation will depend upon a number of factors, including the composition of the S portion and the organosol, the molecular weight of the organosol, the particle size of the organosol, the D:S ratio of the polymeric binder, the pigment used in making the toner composition, and the ratio of organosol to pigment. In addition, preferred charge control agent levels will depend upon the nature of the electrophotographic imaging process. The level of charge control agent can be adjusted based upon the parameters listed herein, as known in the art. The amount of the charge control agent, based on 100 parts by weight of the toner solids, is generally in the range of 0.01 to 10 parts by weight, preferably 0.1 to 5 parts by weight.

The conductivity of a liquid toner composition can be used to describe the effectiveness of the toner in developing electrophotographic images. A range of values from $1\times10^{-11}$ mho/cm to $3\times10^{-10}$ mho/cm is considered advantageous to those of skill in the art. High conductivities generally indicate inefficient association of the charges on the toner particles and is seen in the low relationship between current density and toner deposited during development. Low conductivities indicate little or no charging of the toner particles and lead to very low development rates. The use of charge control agents matched to adsorption sites on the toner particles is a common practice to ensure sufficient charge associates with each toner particle.

Other additives may also be added to the formulation in accordance with conventional practices. These include one or more of UV stabilizers, mold inhibitors, bactericides, fungicides, antistatic agents, gloss modifying agents, other polymer or oligomer material, antioxidants, and the like.

The particle size of the resultant charged toner particles can impact the imaging, fusing, resolution, and transfer characteristics of the toner composition incorporating such particles. Preferably, the volume mean particle diameter (determined with laser diffraction) of the particles is in the range of about 0.05 to about 50.0 microns, more preferably in the range of about 3 to about 10 microns, most preferably in the range of about 1.5 to about 5 microns.

Liquid toner compositions have been manufactured using dispersion polymerization in low polarity, low dielectric constant carrier solvents for use in making relatively low glass transition temperature ($T_g \leqq 30°$ C.) film-forming liquid toners that undergo rapid self-fixing in the electrophotographic imaging process. See, e.g., U.S. Pat. Nos. 5,886,067 and 6,103,781. Organosols have also been prepared for use in making intermediate glass transition temperature ($T_g$ between 30–55° C.) liquid electrostatic toners for use in electrostatic stylus printers. See e.g. U.S. Pat. No. 6,255,363 B1. A representative non-aqueous dispersion polymerization method for forming an organosol is a free radical polymerization carried out when one or more ethylenically-unsaturated monomers, soluble in a hydrocarbon medium, are polymerized in the presence of a preformed, polymerizable solution polymer (e.g. a graft stabilizer or "living" polymer). See U.S. Pat. No. 6,255,363.

Once the organosol has been formed, one or more additives can be incorporated, as desired. For example, one or more visual enhancement additives and/or charge control agents can be incorporated. The composition can then subjected to one or more mixing processes, such as homogenization, microfluidization, ball-milling, attritor milling, high energy bead (sand) milling, basket milling or other techniques known in the art to reduce particle size in a dispersion. The mixing process acts to break down aggregated visual enhancement additive particles, when present, into primary particles (having a diameter in the range of 0.05 to 1.0 microns) and may also partially shred the dispersed copolymeric binder into fragments that can associate with the surface of the visual enhancement additive or colorant.

According to this embodiment, the dispersed copolymer or fragments derived from the copolymer then associate with the colorant, for example, by adsorbing to or adhering to the surface of the pigment particles, thereby forming toner particles. The result is a sterically-stabilized, nonaqueous dispersion of toner particles having a size in the range of about 0.1 to 20 microns, with typical toner particle diameters in the range 0.25–10 microns. In some embodiments, one or more charge control agents can be added after mixing, if desired.

Several characteristics of liquid toner compositions are important to provide high quality images. Toner particle size and charge characteristics are especially important to form high quality images with good resolution. Further, rapid self-fixing of the toner particles is an important requirement for some liquid electrophotographic printing applications, e.g. to avoid printing defects (such as smearing or trailing-edge tailing) and incomplete transfer in high-speed printing. Another important consideration in formulating a liquid toner composition relates to the durability and archivability of the image on the final receptor. Erasure resistance, e.g.

resistance to removal or damage of the toned image by abrasion, particularly by abrasion from natural or synthetic rubber erasers commonly used to remove extraneous pencil or pen markings, is a desirable characteristic of liquid toner particles.

Another important consideration in formulating a liquid toner is the tack of the image on the final receptor. It is desirable for the image on the final receptor to be essentially tack-free over a fairly wide range of temperatures. If the image has a residual tack, then the image can become embossed or picked off when placed in contact with another surface (also referred to as blocking). This is particularly a problem when printed sheets are placed in a stack. Resistance of the image on the final image receptor to damage by blocking to the receptor (or to other toned surfaces) is another desirable characteristic of liquid toner particles.

Transparency projections systems 2 are common in commerce. The system 2 shown in FIG. 1 shows a light projection source 4, usually containing a strong white light bulb 6 that emits light 8 which is focused by a collecting lens 7 unto the entrance of the imaging lens 13. The focused light 8 passes through a transparency 10 which absorbs the focused light 8 in an imaged pattern in the transparency 10. This produces transmitted light 12 in the pattern of the image on the transparency 10. This transmitted light reflects off of a mirror surface 14 and is projected by lens 13 to a well-focused a greatly magnified image on screen 20. The high degree of magnification in such an imaging system serves to amplify any quality deficiencies that may be present in the transparency 10. Because the projected image is significantly larger in size than the original image on the transparency, all image defects are readily observed in the magnified image on the screen. When these deficiencies also affect color balance and faithfulness, the projected image quality can be highly diminished and detracts from the value of the image. It is therefore necessary to ensure good quality image affecting components in the transparency to reduce any adverse effects.

Any number of transparency receptors are suitable for use in the present invention. The transparency receptor generally involves a transparent polymeric resin sheet such as a polyester sheet, e.g., polyethylene terephthalate. Optionally, a coating may be used on the surface of the receptor to receive the toned image. The fixing of the image to the transparency can cause problems since it involves heating the receptor to effect fusing of the toned image to the receptor surface. The image is generally fixed and the temperature range is from 115 to 210 degrees C., which requires a great deal of thermal stability on the part of the OHP transparency composite. The thermal fixing also often involves pressing, and therefore occurs at considerable pressures which may cause serious deformations in the film transparency. This standard fixing treatment is not the same as the scatter reduction fusing that is performed in the practice of the present invention.

It is difficult to place precise numbers on the amount of carrier (by weight or volume) that may be trapped within the fused color element. With different binders, different particle sizes, less importantly on the different carrier liquids, different colors in the pigments, different topography to the pigment particles, etc., the amount of carrier liquid trapped will have varying degrees of effects upon the performance or contribution of benefits according to the present invention. The consideration of the numbers presented herein must be understood in this light, so that the values are only absolute values where so stated. That is, when a percentage of about 5%–10% by total weight of the toner is given for the carrier liquid, this may be considered accurate only to a whole number integer, while a value of exactly 5%–10% would indicate an accuracy of 0.1% units. Similarly, with respect to void volume, if a free volume (the amount of volume between solids in the fused image) is indicated as about 2%–8% of the total volume, that value is accurate only to one whole integer, while a value of exactly 2%–8% would be accurate to ±0.1%.

In normal fusion of electrostatically transferred liquid developer, it is necessary to have about 30–75% by weight of the developer present as the organic carrier. The development considerations to date, however, have indicated that the proper way of fusing the image is to use as low a temperature as is available (conserving energy and reducing potential damage to the toner, the binder and the surface to which it is being fused) and allowing trapped carrier liquid to diffuse out of and evaporate from the fused toner image elements. This standard procedure tends to cause the fused toner to have significant voids within the fused toner, and the particle/void interface is what allows the light scattering effect to occur. By reducing the void content in the fused toner element, the scattering effect is reduced. There are a number of theories on how this occurs, but the present invention is not limited to the various theories, but rather is tied to the fact of the scatter reduction.

One hypothesis which is favored by the inventors as an explanation of the observed phenomenon is the co-coalescence/evaporation effect of the process. It is believed that the previously used low-intermediate fusion temperatures did not surpass the effective Tg of the polymer binder, allowed the particles to merely surface fuse or sinter with adjacent particles, and maintained a free volume (non-solids volume) between toner particles that was partly filled by carrier and air. The carrier was then allowed to evaporate from the fused color element, and air would replace the free volume previously containing carrier liquid. This standard imaging technique allowed the theoretic presence of as much as 33.7% volume free space (which is the theoretic volume maximum free space for stacked spheres). In actuality, with some polymer softening, less than perfect spheres and some particle to particle adherence, reducing free space volume, the voids are likely to be more on the order of 15–25%. This still provides significant particle/air interface for light scattering to occur in transparencies. In the practice of the present invention, a higher fusion temperature is used which causes particles to exceed their effective Tg, flow into free space as the carrier evaporates, and reduce the amount of free volume available for air. By reducing the free volume available for air, the amount of air/particle interface is substantially reduced, and the light scattering effect is likewise reduced. The important process features in the achievement of these results is the coalescence and flow of the particles, while evaporating substantially all, up to 95%, up to 99%, up to 100% of the carrier liquid, thereby reducing free volume. Some carrier liquid (preferably less than 1% but at least less than 10% or less than 5% or less than 2%) may remain within the fused color element, which indicates some acceptable instability in the quality of the reduced light scattering effect, but the important result is the reduction of free volume within the element, reducing the potential for light scattering phenomena.

The invention can also be detected according to more qualitative analysis. For example, if a liquid developer is fixed to a transparent substrate support for an overhead transparency in an overhead projection system under standard development conditions (fusion at about 140° C., which is within about 80–90° C. above the effective Tg of the toner) and the same liquid developer is fixed to a transparent substrate support for an overhead transparency in an overhead projection system under the advanced development conditions of the invention (fusion at about 150° C., which is within about 100–125° C. above the effective Tg of the toner), the scattering reduction effect can be noted.

As noted earlier, the free volume or void content between toner particles is believed to the culprit in causing light scattering in the projection of images through overhead transparencies or other through the media projections. It is believed that the prior art processes produced free volume content in excess of 15% by volume of the color image element. The term color image element refers to the final image material formed on the substrate from the electrostatically deposited liquid toner, whether it is in a spot, dot, line, or film form.

In the practice of the present invention, it is believed that the void content is less than 12%, preferably less than 10%, less than 9%, less than 8%, less than 7%, less than 6%, less than 5%, less than 4%, less than 3%, and in some cases there has been evidence that the free volume may be less than 3%, less than 2%, and approaching actual film quality with near 0 void content. A preferred achievable range would be with a void content between 0.5% and 10%, between 0.5% and 9%, between 1% and 9%, between 1% and 8%, between 1.5% and 7%, and between 2% and 7% to achieve readily ascertainable benefits.

The following non-limiting examples are provided to assist in further understanding of the invention, with the numbers, ranges, and materials being merely exemplary within the generic scope of the invention, and not being intended to limit the practice of the invention.

EXAMPLE

The following abbreviations are used in the examples:

EA: Ethyl Acrylate (available from Aldrich Chemical Co., Milwaukee, Wis.)

EMA: Ethyl methacrylate (available from Aldrich Chemical Co., Milwaukee, Wis.)

HEMA: 2-Hydroxyethyl methacrylate (available from Aldrich Chemical Co., Milwaukee, Wis.)

Norpar™ 12: A proprietary aliphatic hydrocarbon blend comprising mostly dodecane (available from Exxon Chemical Co., Baytown, Tex.).

TCHMA: Trimethyl cyclohexyl methacrylate (available from Ciba Specialty Chemical Co., Suffolk, Va.)

TMI: Dimethyl-m-isopropenyl benzyl isocyanate (available from CYTEC Industries, West Paterson, N.J.)

Zirconium HEX-CEM: (metal soap, zirconium octoate, available from OMG Chemical Company, Cleveland, Ohio)

A yellow pigmented organosol liquid toner having an effective core $T_g$ of 65° C. was prepared generally according to the method described in Comparative Example 16 of the referenced U.S. patent application Ser. No. 10/612,535. The yellow ink was prepared at 14.6% w/w organosol solids in Norpar™ 12, using a ratio of organosol solids to pigment solids of 5/1 w/w. A blend of yellow two yellow pigments was used as the colorant: 90% w/w Pigment Yellow 138 (available from Clariant Corp., Wilmington Del.) and 10% w/w Pigment Yellow 83, (available from Sun Chemical Corp., Cincinnatti, Ohio). The organosol, designated TCHMA/HEMA-TMI//EMA (97/3-4.7//100% w/w), was prepared generally according to Comparative Examples 2 and 7 of the referenced U.S. patent application Ser. No. 10/612,535, from a graft stabilizer comprising a copolymer of TCHMA and HEMA containing random side chains of TMI, covalently bonded through the vinyl group of the TMI to a thermoplastic core comprising EMA. The core/shell ratio was 8/1 w/w. The calculated glass transition temperature of the core is 65° C. A charge director solution comprising 30 mg of 24% w/w Zirconium HEX-CEM in mineral spirits was added to the toner before milling, and milling was effected for 215 minutes at 80° C. The resulting liquid toner exhibited a volume mean particle diameter of 3.1 microns, and a charge per mass of 133 micro-Coulombs/g.

A second yellow pigmented organosol liquid toner having an effective core $T_g$ of 50° C. was prepared generally according to the method described in Comparative Example 16 of the referenced U.S. patent application Ser. No. 10/612,535. The yellow ink was prepared at 13.97% w/w organosol solids in Norpar™ 12, using a ratio of organosol solids to pigment solids of 5/1 w/w. A blend of yellow two yellow pigments was used as the colorant: 90% w/w Pigment Yellow 138 (available from Clariant Corp., Wilmington Del.) and 10% w/w Pigment Yellow 83, (available from Sun Chemical Corp., Cincinnatti, Ohio). The organosol, designated TCHMA/HEMA-TMI//EA-EMA (97/3-4.7//13-87% w/w), was prepared generally according to Comparative Examples 2 and 7 of the referenced U.S. patent application Ser. No. 10/612,535, from a graft stabilizer comprising a copolymer of TCHMA and HEMA containing random side chains of TMI, covalently bonded through the vinyl group of the TMI to a thermoplastic copolymeric core comprising EA and EMA. The core/shell ratio was 8/1 w/w. The calculated glass transition temperature of the core is 50° C. A charge director solution comprising 35 mg of 24% w/w Zirconium HEX-CEM in mineral spirits was added to the toner before milling, and milling was effected for 215 minutes at 80° C. The resulting liquid toner exhibited a volume-mean particle diameter of 2.8 microns, and a charge per mass of 163 micro-Coulombs/g.

A cyan pigmented organosol liquid toner was prepared from the same 50° C. core $T_g$ organosol at 14.8% w/w organosol solids in Norpar™ 12, using a ratio of organosol solids to pigment solids of 6/1 w/w. Pigment Blue 15:4 (available from Sun Chemical Corp., Cincinnatti, Ohio) was used as the colorant. A charge director solution comprising 25 mg of 24% w/w Zirconium HEX-CEM in mineral spirits was added to the toner before milling, and milling was effected for 165 minutes at 80° C. The resulting liquid toner exhibited a volume mean particle diameter of 2.9 microns, and a charge per mass of 210 micro-Coulombs/g.

A magenta pigmented organosol liquid toner was prepared from a compositionally similar 50° C. core $T_g$ organosol having a core/shell ratio of 6 at 13.6% w/w organosol solids in Norpar™ 12, using a ratio of organosol solids to pigment solids of 5/1 w/w. Pigment Red 81:4 (available from Magruder Chemical Corp.) was used as the colorant. A charge director solution comprising 12.5 mg of 24% w/w Zirconium HEX-CEM in mineral spirits was added to the toner before milling, and milling was effected for 60 minutes at 80° C. The resulting liquid toner exhibited a volume mean particle diameter of 2.9 microns, and a charge per mass of 120 micro-Coulombs/g.

A third yellow pigmented organosol liquid toner having an effective core $T_g$ of 35° C. was prepared generally according to the method described in Comparative Example 16 of the referenced U.S. patent application Ser. No. 10/612,535. The yellow ink was prepared at nominally 12% w/w organosol solids in Norpar™ 12, using a ratio of organosol solids to pigment solids of 5/1 w/w. A blend of yellow two yellow pigments was used as the colorant: 90% w/w Pigment Yellow 138 (available from Clariant Corp., Wilmington Del.) and 10% w/w Pigment Yellow 83, (available from Sun Chemical Corp., Cincinnatti, Ohio). The organosol, designated TCHMA/HEMA-TMI//EA-EMA (97/3-4.7//27-73% w/w), was prepared generally according to Comparative Examples 2 and 7 of the referenced U.S. patent application Ser. No. 10/612,535, from a graft stabilizer comprising a copolymer of TCHMA and HEMA containing random side chains of TMI, covalently bonded through the vinyl group of the TMI to a thermoplastic copolymeric core comprising EA and EMA. The core/shell ratio was 8/1 w/w. The calculated glass transition temperature of the core is 35° C. A charge director solution comprising 5 mg of 24% w/w Zirconium HEX-CEM in mineral spirits was added to the toner before milling, and milling was effected for 90 minutes at 80° C. The resulting liquid toner exhibited a volume mean particle diameter of 3.0 microns, and a charge per mass of 165 micro-Coulombs/g.

In a series of experiments, the inventors tested a variety of parameters to determine the best conditions for printing high quality liquid toned that yield transparent projected images when fused onto overhead transparency film. Polyester film sheets of thickness 0.002 inches was utilized as the overhead transparency support for this experiment because higher voltages are required for thicker calipers.

Given below are the results of a headspace analysis done when the toned image was fused on plain polyester without any coating at optimum conditions. The fresh samples were taken immediately after fusing, weighed and placed in a headspace sample vial. The aged samples were taken approximately 3 months after fusing from a 3 ring binder on an office shelf. Given below are the results which were compiled using an average of two samples for each condition. The headspace analysis was run by Aspen Research of White Bear Lake, Minn.

| Color & Condition | % of Norpar ® 12 carrier liquid in finished sample |
|---|---|
| Cyan - aged | 0.22 |
| Cyan - fresh | 0.48 |
| Magenta - aged | 0.15 |
| Magenta - fresh | 1.46 |
| Yellow - aged | 0.08 |
| Yellow - fresh | 1.21 |

Figure 2:
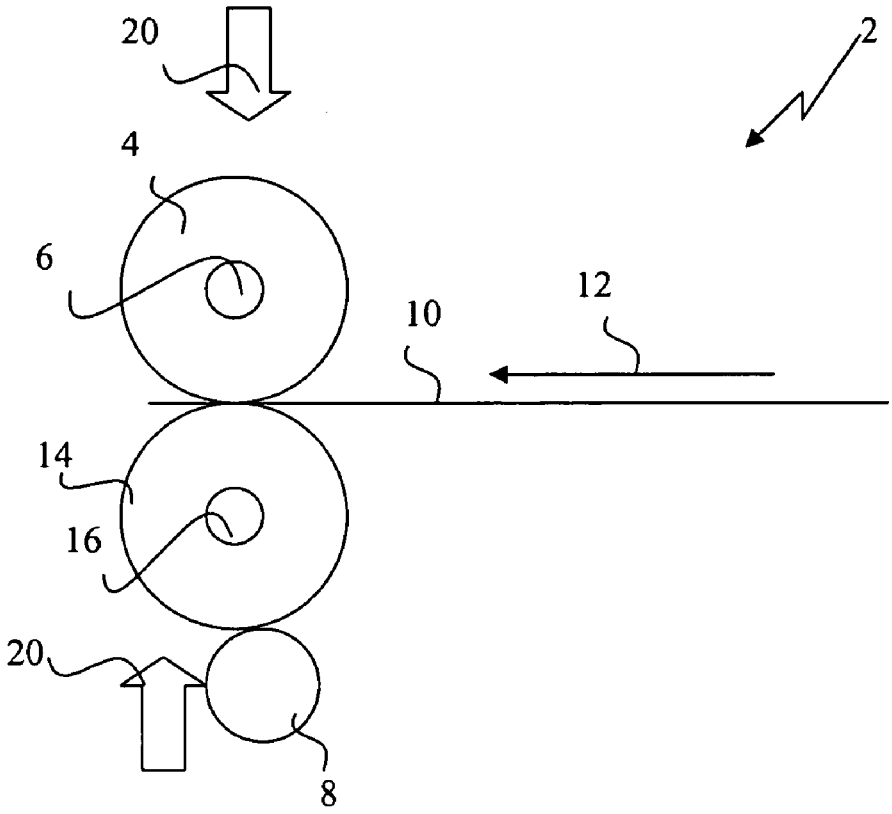
FIG. 2 shows a schematic of a fusion roller apparatus according to the present invention.

The conditions for optimum fusing for +50 $T_g$ inks was a temperature of 155+/−5° C. for each roll in a set of two fusing rollers (top and bottom). The test jig shown in FIG. 2 consisted of two hollow 35 mm coated rollers 4, 14, each fitted with a 500 watt halogen lamp 6, 16 as a heat source. The two fusing rollers 4, 14 were driven by contact from a third roller 8 below the backside fuser roller 14. The rollers that were used in this example consisted of a silicone rubber base with a 0.025+/−0.005 inch overcoat layer of a known polydimethyl siloxane formula. The top roller 4 had a Shore A 10 durometer base hardness and the bottom roller 14 had a shore A 20 durometer. The rollers were obtained from the Bando Corporation (Japan) and the coating was applied by the inventors. Dwell time in the nip 18 was approximately 0.03 sec. (4.5 mm nip@ 5 inches per second (ips)), with a dwell time of 0.01 to 0.08 seconds being generally used. Pressure indicated by arrows 20 on the fusing rollers 4, 14 was approximately 19 lb/in$^2$ for all material evaluated for headspace analysis. A speed range of 3 to 8 lineal inches per second was believed to be a preferred range for the speed of fusing.

Even though the fresh samples contain more Norpar® 12 than the aged samples, the aged samples did not exhibit a decrease in transparency when observed before sampling for headspace analysis. This indicates a possibility that the final organic carrier concentration is, by itself, not the ultimate determining factor in reduced light scattering.

Another experiment was run to determine minimum as well as maximum (if any) pressure 20 required for fusing the different colored transparencies at optimum temperatures previously determined. Although a maximum pressure for good results was never determined in this experiment, (these were limited by the maximum force that could be applied) it is clear that eventually, at some very high pressure, it is believed that ink would stick to the fuser roll (fuser offset) and ruin the image quality. Given below are the results of the pressure experiment. A range of pressures from 8 lb/in$^2$ to 34 lb/in$^2$ was employed in this investigation. Failure was noted below 8 lb/in$^2$ for all colors; however, all pressure settings above this minimum pressure resulted in acceptable transparency image quality.

The pressures 20 were set using an airline hookup to the top (image fusing) roller 4 and the bottom (drive) roller 14. All pressures were checked by the use of a calibrated Tekscan pressure gage (Tekscan Inc. 307 W. First Street; South Boston, Mass. 02127).

| Color-All inks used were +50$T_g$ | Temperature | Pressure fuser rolls-Lbs./in$^2$/9 in | PSI based on Nip Width | Result |
|---|---|---|---|---|
| Yellow | 160 | 8.3 | 8 | Fail |
| Yellow | 160 | 27 | 19 | Pass |
| Yellow | 160 | 28 | 20 | Pass |
| Yellow | 160 | 51 | 27 | Pass |
| Yellow | 160 | 72 | 34 | Pass |
| Magenta | 160 | 8.3 | 8 | Fail |
| Magenta | 160 | 27 | 19 | Pass |
| Magenta | 160 | 51 | 27 | Pass |
| Cyan | 150 | 8.3 | 8 | Fail |
| Cyan | 150 | 27 | 19 | Pass |
| Cyan | 150 | 51 | 27 | Pass |

Untreated polyester having a thickness of 0.002 inches was always used as the imaging medium (this keeps the transfer voltage relatively low). No additional fluid or coating of the polyester was necessary to obtain acceptable results. Good durability results were obtained on all acceptable prints with a transparent image. Durability was checked by means of erasure resistance ASTM Test # F 1319-Determination of Abrasion and Smudge Resistance of Images Produced from Business Copy Products (Crockmeter Method).

All fusing conditions were run at 5 ips on the offline fusing jig and all samples were fused immediately after printing. The images were printed onto the polyester by means of a proprietary print testing jig.

Some additional experiments involving liquid ink formulations having varied $T_g$'s. A liquid toner prepared as described previously having a $T_g$ of +35 was printed to the transparency as described above. At 110° C., the fusing temperature was not sufficiently above the effective $T_g$ of the toner to provide a quality transparency image. When the fuser temperature was raised to at least 130° C., the resulting transparency was a vivid yellow (the toner color) when viewed on the overhead projector.

The experiment was repeated for a higher $T_g$ ink, having a $T_g$ of +65. It was necessary for this toner formulation to have a fusing temperature of 200° C. For both of these sets of experiments, the pressure applied to the two fusing rollers was about 14 pounds.

COMPARATIVE EXAMPLE

In the preparation of good quality transparencies using the contact development method (with liquid ink) and the fusing of the plated ink on polyester sheets, it has been observed that a significant amount (at least 25%–35%) of carrier solvent for the liquid ink must be present before fusing in order to obtain a transparency that does not scatter the transmitted light out of the imaging aperture in a standard transparency projector.

In this particular experiment, the ink used was dispersed in Norpar® 12 carrier solvent and the estimated Tg for the ink (in the dried state) was 50 Tg. A good transparency was made by using this ink and plating it onto a 0.002 inch thick polyester sheet by following the formula for plating and fusing that was previously provided in the positive examples. Having done this, a second image was plated onto a second polyester sheet using the same development and transfer parameters that were used to produce the good transparency. However, this second image on polyester was not fused immediately after plating. Instead, this second transparency was allowed to dry for 24 hours at room temperature so that the plated ink was almost completely free of carrier solvent (95+% solids). This dried (but not fused) "transparency" was viewed on a standard projector and seen to be almost black in color (even though yellow ink was used) because of a large amount of scattered light (in the inked areas) that was not able to enter the imaging lens of the projector.

Next, this dry transparency was fused at the pressure and temperature (approximately 20 psi and 150° C.) previously used to produce good transparencies (in the "fuse just after plating mode") but the result was not positive. In fact, when viewed on a standard transparency projector, this sample that had been fused 24 hours after plating was not transparent at all. The image on the projection screen looked black and white rather than yellow and white (the desired result). This experiment illustrates the need to fuse the plated ink while the carrier solvent is present in order to obtain good transparencies with liquid ink printing. The large amount of scattering in the transparency that was fused "dry" shows that the ink film had not coalesced into a uniform film during fusing but still remained an agglomeration of separate particles that produced significant light scattering at the particle boundaries.

What is claimed:

1. A method of reducing light scattering in a projection transparency formed with a electrostatically deposited color image comprising:

providing a transparent support substrate;

forming an electrostatically deposited color developer image on the support substrate, the color developer image containing at least 25% by weight of organic liquid carrier, the color developer having dispersed particles comprising thermoplastic polymer therein, said dispersed particles having an effective Tg; and heating the color developer image on the support at a temperature and for a time that the thermoplastic polymer coalesces and at least some of the organic liquid carrier evaporates at a rate that free volume between the particles is reduced and light scattering is thereby reduced; wherein the free volume is reduced to less than 12% by volume of dried color developer.

2. The method of claim 1 wherein heating is performed at a temperature at least 100° C. above the effective Tg of the dispersed particles.

3. The method of claim 2 wherein the free volume is reduced to less than 10% by volume of dried color developer.

4. The method of claim 2 wherein heating is performed at between 150 and 160° C. to coalesce the dispersed particles and evaporate organic liquid carrier.

5. The method of claim 4 wherein organic liquid carrier is evaporated to leave between 1 and 3% by weight of dried liquid developer as organic carrier.

6. The method of claim 2 wherein the electrostatically deposited color image is first formed on an intermediate surface, the heating is performed and then the heated deposited color image is physically transferred to the transparent support substrate.

7. The method of claim 2 wherein the electrostatically deposited color image is electrostatically deposited onto the transparent support substrate.

8. The method of claim 1 wherein the electrostatically deposited color image is first formed on an intermediate surface, the heating is performed and then the heated deposited color image is physically transferred to the transparent support substrate.

9. The method of claim 1 wherein the electrostatically deposited color image is electrostatically deposited onto the transparent support substrate, and toner particle coalescence is induced by heating the deposited color image to a temperature high enough above the effective glass transition temperature of the liquid toner particles to induce coalescence, but below a temperature required to fuse the toned image to the transparent support substrate, and subsequently heating the coalesced toned image to a higher temperature than the heating, the higher temperature being sufficient to fuse the toned image to the transparent support surface.

10. The method of claim 2 wherein applied force on the deposited color image during heating was at least 8 $lb/in^2$.

11. The method of claim 1 wherein applied force on the deposited color image during heating was at least 8 $lb/in^2$.

12. The method of claim 2 wherein applied force on the deposited color image during heating was between 8 $lb/in^2$ and 34 $lb/in^2$, dwell time during heating was between 0.01 and 0.08 seconds, and lineal speed of the deposited color image during heating was between 3 and 8 inches per second.

13. The method of claim 3 wherein applied force on the deposited color image during heating was between 8 $lb/in^2$ and 34 $lb/in^2$, dwell time during heating was between 0.01 and 0.08 seconds, and lineal speed of the deposited color image during heating was between 3 and 8 inches per second.

14. The method of claim 4 wherein applied force on the deposited color image during heating was between 8 $lb/in^2$ and 34 $lb/in^2$, dwell time during heating was between 0.01 and 0.08 seconds, and lineal speed of the deposited color image during heating was between 3 and 8 inches per second.

* * * * *